United States Patent [19]

Cheng

[11] Patent Number: 4,988,103

[45] Date of Patent: Jan. 29, 1991

[54] GEOMETRIC PUZZLE OF SPHERES

[76] Inventor: Ming S. Cheng, 1 Fl., No. 12, Alley 20, Lane 66, Tung Yuang St., Taipei, Taiwan

[21] Appl. No.: 415,962

[22] Filed: Oct. 2, 1989

[51] Int. Cl.[5] ..... A63F 9/12

[52] U.S. Cl. ..... 273/157 R

[58] Field of Search ..... 273/153 R, 153 P, 157; 434/211, 213, 277, 278

[56] References Cited

U.S. PATENT DOCUMENTS

| | | | |
|---|---|---|---|
| 3,837,652 | 9/1974 | Kuwagaki et al. | 273/157 R |
| 3,945,645 | 3/1976 | Roberts | 273/157 R |
| 4,060,247 | 11/1977 | Kobres | 273/157 R |
| 4,650,424 | 3/1987 | Mitchell | 434/211 |
| 4,699,602 | 10/1987 | Giorgi | 434/211 |

*Primary Examiner*—Edward M. Coven

*Assistant Examiner*—W. Pierce

*Attorney, Agent, or Firm*—Morton J. Rosenberg; David I. Klein

[57] ABSTRACT

A fit-together type puzzle comprising a number of ball blocks of varying configurations with each ball block being composed of an equal number of balls joined together. The ball blocks are fitted together with one another to selectably form a planar triangular figure, a planar elongate hexagonal figure, and a solid regular tetrahedral figure. Each ball block is composed of such number of balls that the planar triangular figure is composed of thirty-five balls, the planar elongate hexagonal figure is composed of thirty balls, and the solid regular tetrahedral figure has one side thereof composed of fifteen balls. A board which has recesses or a set of semi-spherical depressions thereon corresponding to the figures is provided to receive the balls blocks.

3 Claims, 5 Drawing Sheets

GEOMETRIC PUZZLE OF SPHERES

BACKGROUND OF THE INVENTION

The present invention relates generally to puzzles. More particularly, the present invention relates to a fit-together type puzzle in which a given number of ball blocks of varying configurations are provided to be fittable together to form a planar equilateral triangular figure, a planar elongate hexagonal figure, or a solid regular tetrahedral figure.

Various fit-together type puzzles are provided to serve educational as well as entertainment purposes. Basically, all these puzzles comprise a given number of planar plates of varying shapes which fit with one another to form a predetermined shape. It is noted that, because said planar plates each are of a planar configuration per se, said predetermined shape uniquely formed therefrom is also a planar configuration such that the educational and entertainment purposes achieved are inevitably reduced.

SUMMARY OF THE INVENTION

A primary objective of the present invention is to provide a fit-together type puzzle in which a plurality of ball blocks, each comprising an equal number of balls joined together, each has a configuration such that the ball blocks are fittable together to form a number of predetermined planar and solid figures.

This and additional objectives, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

Figure 1:
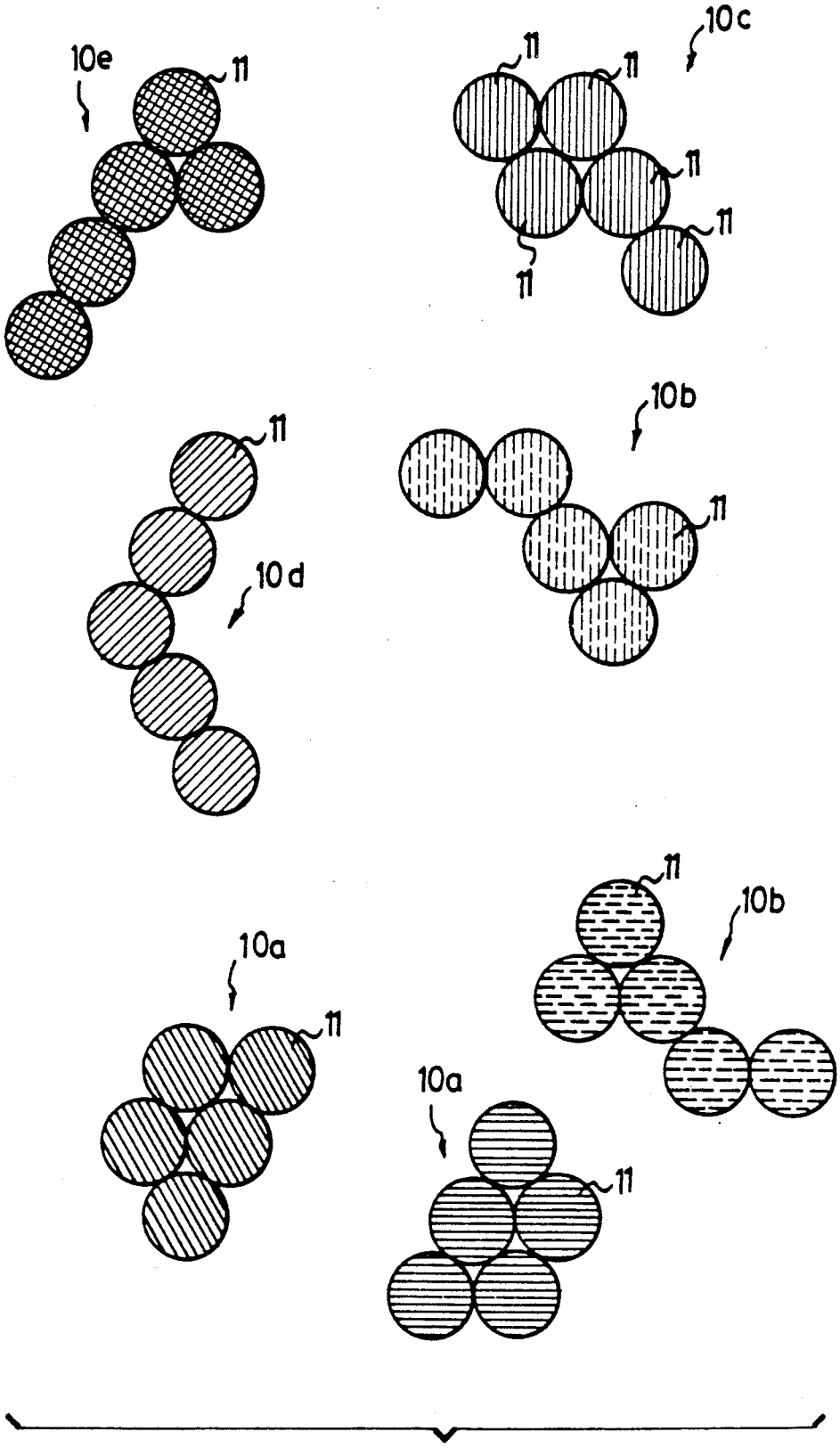
FIG. 1 is a top plan view showing seven ball blocks of a puzzle in accordance with the present invention.

Referring now to the drawings, and more particularly to FIGS. 1 and 2, there is shown the puzzle which comprises a plurality of ball blocks (10*a* to 10*e*) of varying configurations. In this embodiment, seven ball blocks are utilized with each being composed of an equal number of balls 11 joined together. It is noted that two pairs (10*a* and 10*b*) of the seven ball blocks each have two identical ball blocks. As can be clearly seen from FIG. 1, according to the present invention, five balls 11 constitute one ball block. The configuration of each ball block is best seen from FIG. 1. Each ball block can be produced in one piece for example by an injection molding process, or can be joined together by gluing operations. Further, each ball block is of a planar type so that a general plane will pass through respective center points of the balls constituting the ball block.

Figure 2A:
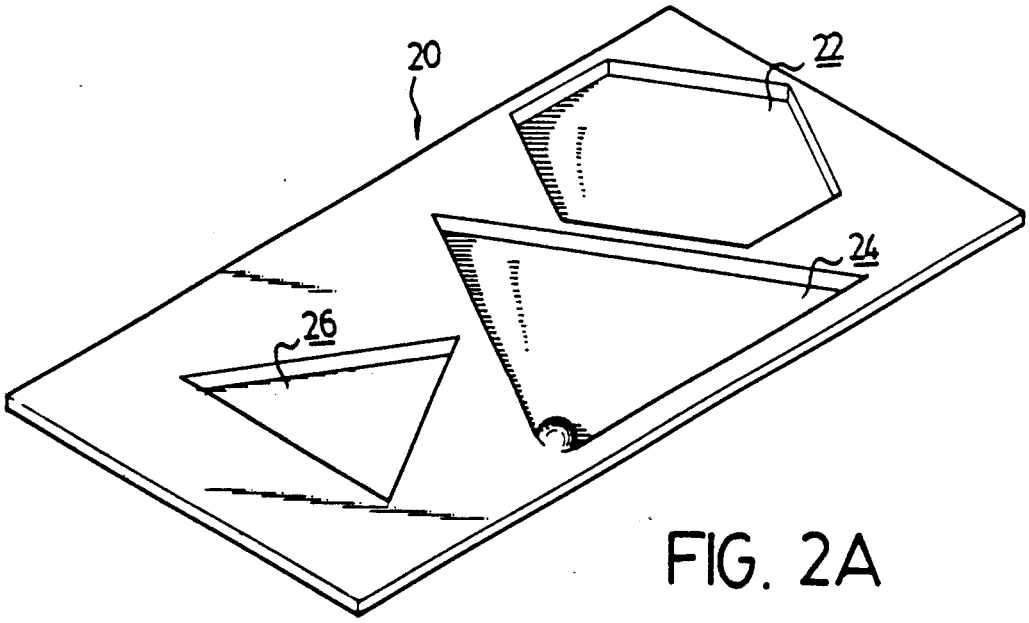
FIG. 2A is a perspective view showing a board having recesses thereon for receiving the ball blocks in accordance with the present invention.
Figure 2B:
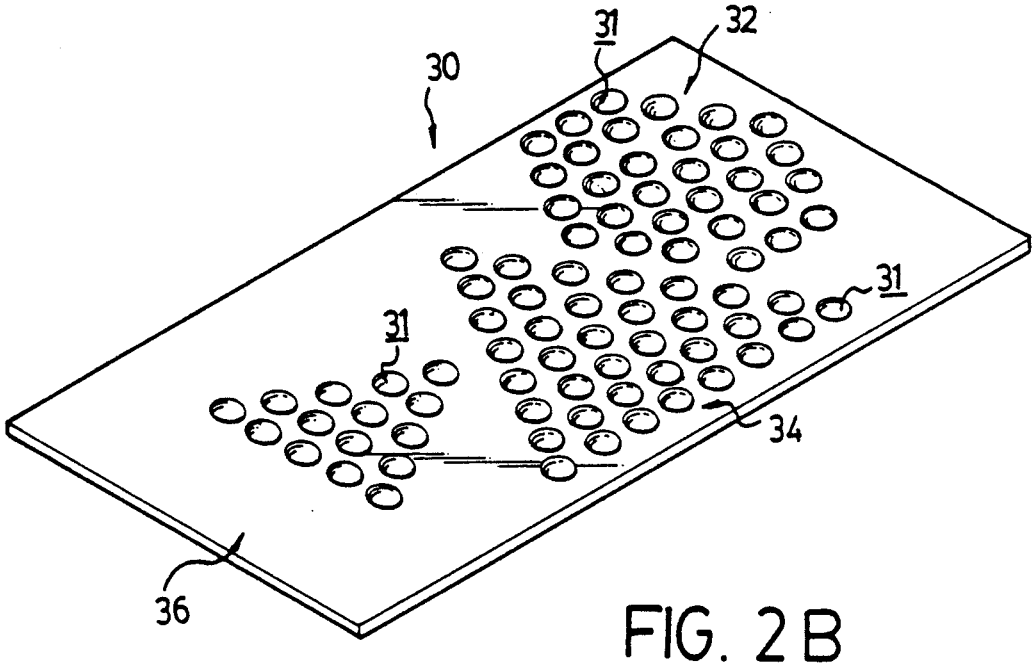
FIG. 2B is a view similar to FIG. 2A but with the recesses replaced by semi-spherical depressions.

FIG. 2A shows a board 20 of this invention which has three recesses thereon. The board 20 is used to receive the ball blocks 10*a*, 10*a*, 10*b*, 10*b*, 10*c*, 10*d*, 10*e*, totally or partially, to selectively form a predetermined figure. The three recesses, indicated by reference numerals 22, 24 and 26, are shaped substantially as a larger equilateral triangular shape, an elongate hexagonal shape and a smaller equilateral triangular shape, respectively. The shape and size of the respective recesses 22, 24 and 26 are such that a given number of balls can be received therein. Namely, the recess 22 can receive thirty balls so that any six of the seven ball blocks are used; the recess 24 can receive thirty-five balls so that all seven ball blocks are used and one position thereon is left blank; the recess 26 can receive fifteen balls so that all seven ball blocks are used to construct a solid figure. In accordance with the present invention, the recesses 22, 24 and 26 can be replaced by a plurality of semi-spherical depressions 31 corresponding to the number of balls that can be received in the recesses, as clearly shown in FIG. 2B.

Figure 3:
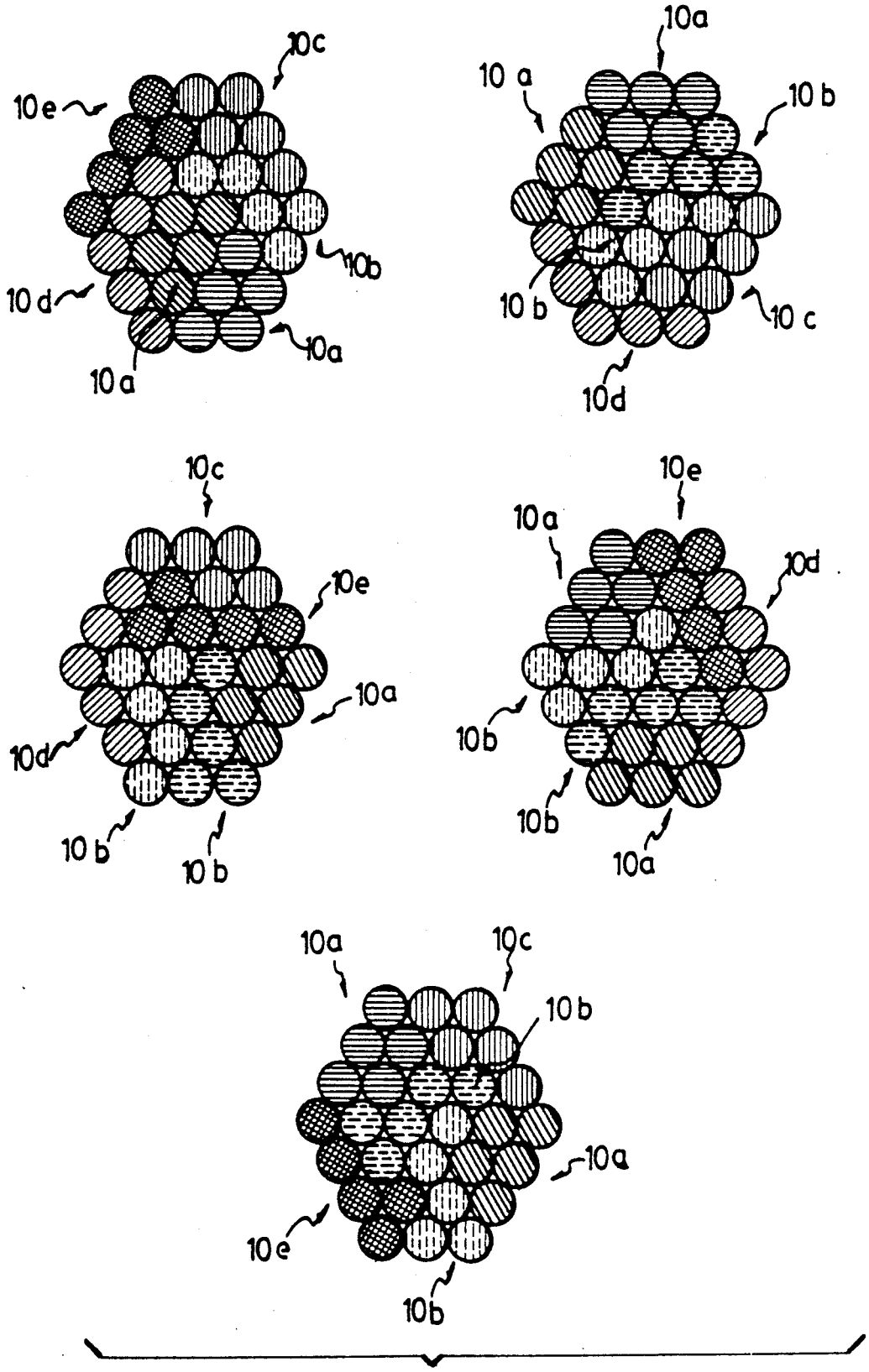
FIG. 3 is an exemplary view showing five solutions for the ball blocks of FIG. 1 to form a planar elongate hexagonal figure in accordance with the present invention.
Figure 4:
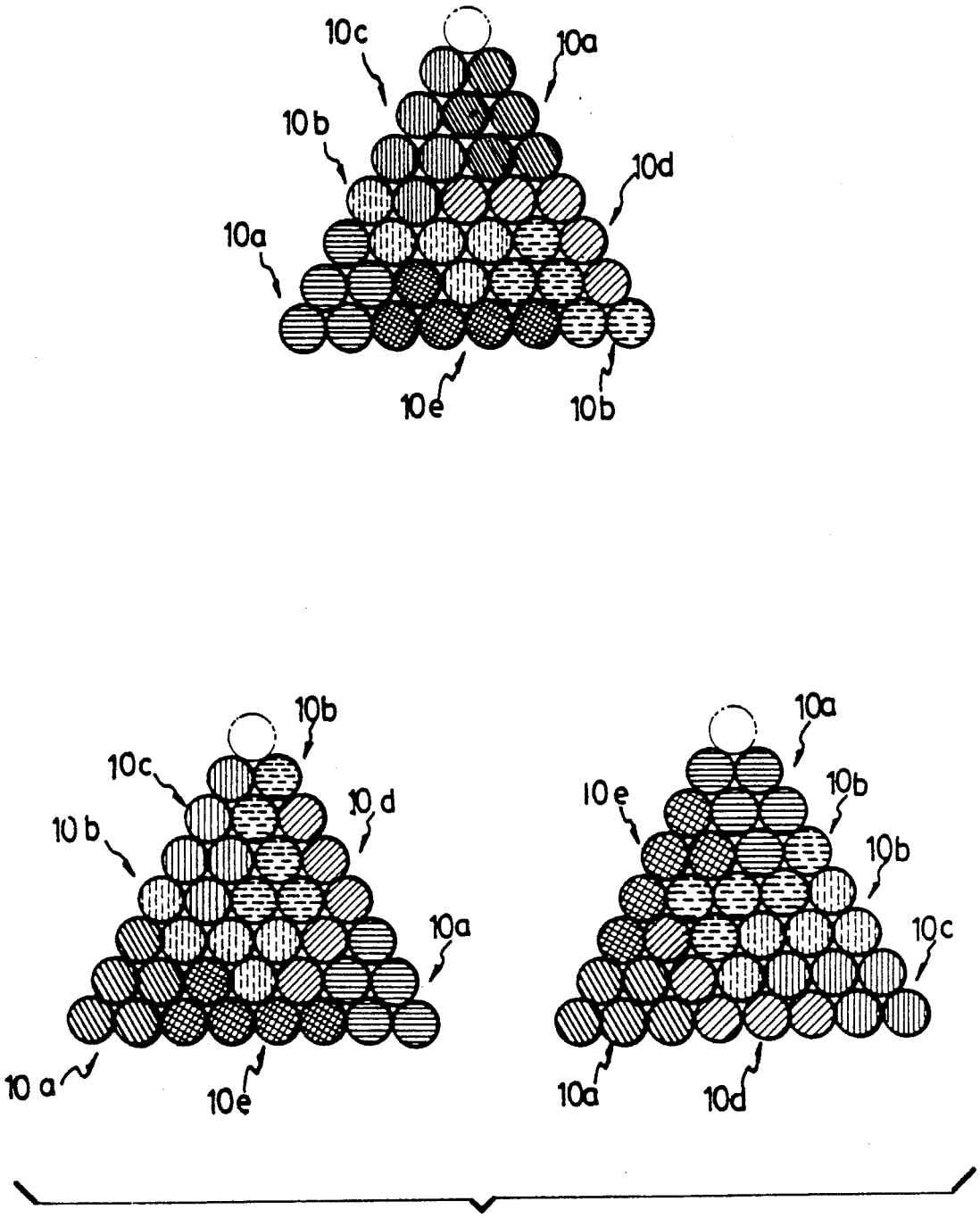
FIG. 4 is a view similar to FIG. 3 but showing three solutions for the ball blocks of FIG. 1 to form a planar equilateral triangular figure.
Figure 5:
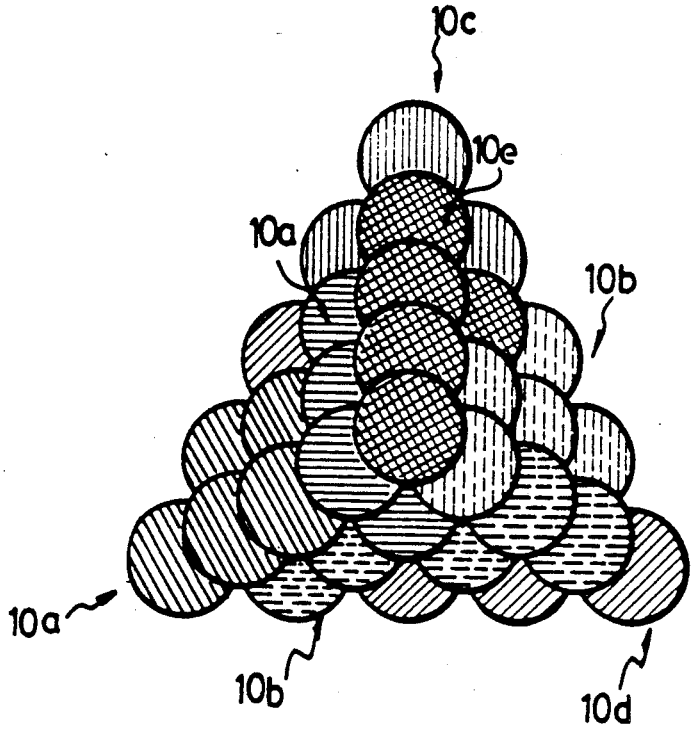
FIG. 5 is a view similar to FIG. 3 but showing one solution for the ball blocks of FIG. 1 to form a solid regular tetrahedral figure.
Figure 5A:
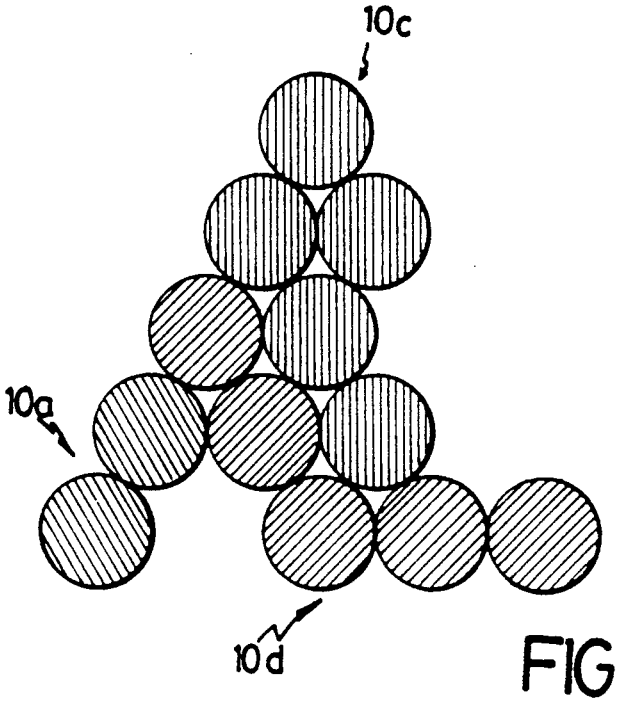
FIG. 5A is a view showing a partial solution for the ball blocks of FIG. 1 to form a solid regular tetrahedral figure.

As described above, in this invention, the ball blocks (10*a* to 10*e*) are designed to be fitted together to selectably form a planar equilateral triangular figure, a planar elongate hexagonal figure, and a solid regular tetrahedral figure, as clearly shown in FIGS. 3 through 5.

While the present invention has been explained in relation to its preferred embodiment, it is to be understood that various modifications thereof will be apparent to those skilled in the art upon reading this specification. Threfore, it is to be understood that the invention disclosed herein is intended to cover all such modifications as fall within the scope of the appended claims.

I claim:

1. A puzzle of a fit-together type comprising:

seven ball blocks with two being identical to the rest, each said ball block being composed of five identical balls joined together in one of the following ways:

(a) a line of 4 balls with one ball placed adjacent to said line of 4 balls and in contact with two end balls in said line of 4 balls;

(b) a first line of 3 balls with a second line of 2 balls placed adjacent to and parallel to said first line of 3 balls with said second line of 2 balls having both balls contacting a central ball of said first line of 3 balls;

(c) a first line of 3 balls with a second line of 2 balls placed adjacent and parallel to said first line of 3 balls with said second line of 2 balls having both balls contacting an end ball of said first line of 3 balls;

(d) a line of 3 balls with one ball placed adjacent to said line of 3 balls so that said one ball contacts two balls of said line of 3 balls and an other ball is placed in contact with a remaining ball of said line of 3 balls on an opposite side of said line of 3 balls to said one ball and at an angle of 120 degrees away from said line of 3 balls;

(e) a V-shaped configuration of said five identical balls with an inside angle of 60 degrees; and, said ball blocks being designed to be fittable together to selectably form a planar equilateral triangular figure constructed from thirty-five balls so that one angle position is left blank, a planar elongated hexagonal figure constructed from thirty balls so that one of said seven ball blocks is left unused, and a solid regular tetrahedral figure constructed from thirty-five balls.

2. A puzzle as claimed in claim 1, further comprising a board for receiving said ball blocks, said board comprising:

a first recess of larger equilateral triangular shape, said first recess is designed to receive thirty-five balls such that one position is left blank;

a second recess of elongated hexagonal shape, said second recess is designed to receive thirty balls such that one of said ball blocks is left unused; and, a third recess of smaller equilateral triangular shape, said third recess is designed to receive fifteen balls so that said solid regular tetrahedral figure composed of thirty-five balls is constructed.

3. A puzzle as claimed in claim 2, wherein said recesses are disposed with a plurality of semi-spherical depressions corresponding to the number of balls received in said recesses.

* * * * *